US006499820B2

(12) United States Patent
Taki

(10) Patent No.: US 6,499,820 B2
(45) Date of Patent: Dec. 31, 2002

(54) APPARATUS AND METHOD OF GENERATING WAVEFORM FOR DRIVING INK JET PRINT HEAD

(75) Inventor: Hideo Taki, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/941,712

(22) Filed: Aug. 30, 2001

(65) Prior Publication Data

US 2002/0036666 A1 Mar. 28, 2002

(30) Foreign Application Priority Data

Aug. 30, 2000 (JP) ..... 2000-266017
Aug. 27, 2001 (JP) ..... 2001-256856

(51) Int. Cl.[7] ..... B41J 24/34
(52) U.S. Cl. ..... 347/10; 347/9

(58) Field of Search ..... 347/10, 11; 358/1.1, 358/1.17, 1.14

(56) References Cited

U.S. PATENT DOCUMENTS 6,312,076 B1 * 11/2001 Taki et al. ..... 347/10

* cited by examiner

*Primary Examiner*—John Barlow
*Assistant Examiner*—Alfred E Dudding
(74) *Attorney, Agent, or Firm*—Oblon, Spivak, McClelland, Maier & Neustadt, P.C.

(57) ABSTRACT

An apparatus and a method of generating waveforms for driving an ink-jet print head. Waveform data for the overall head-driving waveforms per given unit are written in waveform buffers and then sequentially retrieved at a given timing for analog conversion to obtain an analog head-driving waveform signal. Various head-driving waveforms are thus programmably generated.

24 Claims, 10 Drawing Sheets

30

| ADDRESS | HEIGHT VALUE |
|---|---|
| 0 0 0 0 0 | 0 1 1 0 0 0 1 1 |
| 0 0 0 0 1 | 0 1 0 0 1 0 1 0 |
| 0 0 0 1 0 | 0 1 0 1 0 0 0 0 |
| ⋮ | ⋮ |
| 1 1 1 1 0 | 1 0 0 0 0 1 1 0 |
| 1 1 1 1 1 | 1 0 0 1 0 1 0 0 |

APPARATUS AND METHOD OF GENERATING WAVEFORM FOR DRIVING INK JET PRINT HEAD

BACKGROUND OF THE INVENTION

1. Field of the Invention

The present invention relates to an apparatus and a method of generating waveforms for driving a print head used for serial printers such as ink-jet printers and impact dot printers. Particularly, this invention relates to an apparatus and a method of generating driving waveforms for driving a print head, capable of programmably generating driving waveforms by retrieving driving waveforms per wave portion at a given timing from a memory, etc., in which the overall driving waveform data have been stored and converting the overall driving-waveform data into analog signals.

2. Related Background Art

Ink-jet printers have a print head with several nozzles in a sub-scanning (perpendicular) direction. The print head is moved in a main-scanning (horizontal) direction by a carriage mechanism while a paper is being fed, thus producing desired printouts.

The print head discharges ink drops through the nozzles at a given timing based on dot-pattern data developed from printing data entered by a host computer. The ink drops are sprayed onto a printing storage medium such as a printing paper.

Ink-jet printers, however, cannot produce printouts at an intermediate gradation such as gray due to the fact that they discharge ink drops or not, in other words, perform a dot-on/off control.

A known method of producing an intermediate gradation uses a dot matrix of 4×4 or 8×8 for one pixel. Another known technique for producing enhanced gradation is to discharge ink drops of various weights through the same nozzle per dot for dot control so that dots of various diameters are printed on a printing paper.

Variation in head-driving waveforms is required for discharging ink drops of various weights through the same nozzle. Such a known technique is described below.

FIG. 1 is a schematic illustration of an ink-jet printer hardware configuration.

An ink-jet printer 1 is equipped with a printing engine 3 for an actual printing operation and a printer controller 2 that controls the printing engine 3.

The printer controller 2 includes a CPU 24 for executing a control program, etc., stored in a ROM (Read Only Memory) 22, an EEPROM (Electrically Erasable and Programmable Read Only Memory) 21 that is a non-volatile memory for storing various setting-data, a RAM 23 acting as a main memory for the CPU 24 and also an image buffer memory for developing printing data into bit maps, and a custom-IC chip 25 such as an ASIC (Application-Specified Integrated Circuit).

All of these devices in the printer controller 2 are controlled by the CPU 24 via buses connected among the devices. The custom-IC chip 25 outputs signals for controlling several sections that constitute the printing engine 3. The IC chip 25 also acts as an interface for receiving print-command data entered from the host computer 5 via an interface port 4 under IEEE (Institute of Electrical and electronics Engineers)—1284 standards.

The print engine 3 has a motor 31 for driving a carriage (not shown), a print head 32 mounted on the carriage, and a D/A (Digital-to-Analog)-converter IC chip 33 for applying analog driving-voltage waveforms to the print head 32.

A transfer line 27 is a bus line with a bit width corresponding to the number of nozzles mounted on the print head 32. An ink-discharging or -halting signal is sent to the print head 32 per nozzle along the transfer line 27 based on image buffer-data developed in the RAM 23 while a driving voltage to the print head 32 depends on an analog voltage waveform generated by the D/A-converter IC chip 33.

FIG. 2 is a graph showing an example of a head driving-voltage waveform in which the abscissa and the ordinate are time and voltage variation applied on a piezoelectric vibrator of the print head. Several trapezoidal waveform patters such as shown in FIG. 2 are prepared for discharging various sizes of ink drops. The trapezoidal waveform patters are combined for production of various sizes for ink drops.

Trapezoidal waveforms such as shown in FIG. 2 are formed in combination of directed segments. In detail, each of periods from moments T1 to T8 is expressed as vector data with gradient and length.

The known ink-jet printer forms these trapezoidal waveforms as follows.

The D/A-converter IC chip 33 has a memory that stores data in address spaces such as a Table 30 in FIG. 3. In the figure, 8-bit data is stored in each address space expressed by 5-bit data. Each 8-bit data is a value indicating a height in unit length of each directed segment, or segment gradient shown in FIG. 2. There are 32 different gradient values (for 5 bits) in FIG. 3 required for forming each segment of the trapezoidal waveform shown in FIG. 2.

In FIG. 1, in accordance with data on ink-drop sizes carried by a print command sent from the host computer 5, the custom-IC chip 25 designates a gradient address for forming each directed segment and sends the gradient address to the D/A-converter IC chip 33. The transfer line 26 for this data transfer is constituted by 5-bit address buses, clock signal lines for synchronous communications and data-latch signal lines.

Shown in FIG. 4 is a timing chart for each signal line of the transfer line 26 in data transfer. Data are latched at timing when they are fed on address-bus signal lines A0 to A4.

Height values (right column in Table 30) corresponding to the addresses are added by the number of clocks to obtain a height of one directed segment, as illustrated in FIG. 5. It is understood from FIG. 3 that accumulation of the height values (right column in Table 30) like steps by the number of clocks produces one directed segment. The larger the height value, the steeper the gradient whereas the smaller the value, the more gentle the gradient. A value accumulated by an adder is rounded to an appropriate number of bits and converted into an analog voltage based on the number of bits.

The driving-waveform generation described above is, however, restricted in the number of waveform gradients, and hence disadvantageous in generation of complex waveforms.

Formation of further multilevel dots has been studied for further multiple gradation. However, the known driving-waveform generation described above could not be adapted for such multilevel dots due to requirement of more complex driving waveforms.

The known method requires height values corresponding to various gradients of segments in the memory of the D/A-converter IC chip in formation of directed segments. The memory must have a very large storage capacity for generation of further various waveforms, thus resulting in cost-up.

SUMMARY OF THE INVENTION

In view of the problems discussed above, a purpose of the present invention is to provide an apparatus and a method of appropriately generating desired waveforms for driving an ink-jet print head with a simple configuration.

Another purpose of the present invention is to provide an apparatus and a method of generating several and complex waveforms for driving an ink-jet print head for multiple gradation.

In order to attain the purposes, in an apparatus and a method of generating several and complex waveforms for driving an ink-jet print head, waveform data for overall head-driving waveforms is written per given unit in waveform buffers and then sequentially retrieved at a given timing for analog conversion to obtain an analog head-driving waveform signal per given unit.

Therefore, features of a driving-waveform generating apparatus according to claim 1 are writing waveform data for overall head-driving waveforms per given unit in waveform buffers and sequentially retrieving the waveform data at a given timing for analog conversion to obtain an analog head-driving waveform signal per given unit.

Features of a driving-waveform generating apparatus according to claim 2 that is an apparatus for generating at least one assumed waveform for driving an ink-jet print head in accordance with gradation data are a waveform-data writing section for appropriately writing waveform data for overall head-driving waveforms, a waveform-data retrieving section for retrieving the waveform data written in the waveform-data writing section, a digital/analog converting section for converting the waveform data retrieved by the waveform-data retrieving section into an analog signal by digital/analog conversion, and a signal amplifying section for amplifying the analog signal output from the digital/analog conversing section.

A feature of a driving-waveform generating apparatus according to claim 3 is that the waveform-data writing section includes at least one waveform buffer in which the waveform data for the overall head-driving waveforms are temporarily written.

Features of a driving-waveform generating apparatus according to claim 4 are that the waveform-data writing section includes a waveform-buffer group having a plurality of waveform buffers, waveform data for overall various driving waveforms having been written in the waveform buffers, the waveform-data retrieving section selecting any one of the waveform buffers in the waveform-buffer group to retrieve the waveform data.

A feature of a driving-waveform generating apparatus according to claim 5 is that the waveform-buffer group has two waveform buffers, the waveform data being retrieved from one of the waveform buffers for generating waveform data for overall driving waveforms while the next waveform data is written in the other waveform buffer.

A feature of a driving-waveform generating apparatus according to claim 8 is a waveform-data storing section for storing at least one assumed driving-waveform data, data on several points forming a part of the assumed driving-waveform data being stored in the waveform-data storing section as a coordinate-data group.

A feature of a driving-waveform generating apparatus according to claim 9 is a waveform-data supplementation section for interpolating values between the points to the coordinate-data group, thus generating data on the overall driving waveforms.

Features of a driving-waveform generating apparatus according to claim 10 are that the waveform-buffer group has two waveform buffers, the waveform data being retrieved from one of the waveform buffers while the waveform-data supplementation section is interpolating the values between the points to the coordinate-data group, thus generating data on the overall driving waveform and the data on the overall driving waveforms is written in the other waveform buffer.

A feature of a driving-waveform generating apparatus according to claim 17 is that written in the one waveform buffer is a print head-control signal other than the driving waveforms in addition to the waveform data for overall head-driving waveforms, the control signal being retrieved by the waveform-data retrieving section and being applied to the print head.

Features of a driving-waveform generating apparatus according to claim 18 are that the waveform data for overall driving waveforms is converted into an analog signal by the digital/analog converting section and the analog signal is amplified by the signal amplifier, thus being output to the print head whereas the print head-control signal other than the driving waveform is output to the print head as it is as a digital signal.

A feature of a driving-waveform generating apparatus according to claim 19 is that the one waveform buffer has a storage capacity of 16 bits in a longitudinal direction and a given number of bits in a horizontal direction, the waveform data for overall driving waveforms being written on upper 10 bits among the 16 bits in the longitudinal direction, the print head-control signal other than the driving waveforms being written in lower 6 bits among the 16 bits in the longitudinal direction.

A feature of a driving-waveform generating apparatus according to claim 20 is that the print head-control signal other than the driving waveforms includes a waveform completion signal indicating completion of the waveforms, the least significant bit of the 16 bits in the longitudinal direction being used as an end bit in which the waveform completion signal is written.

A feature of a driving-waveform generating apparatus according to claim 21 is that when the waveform completion signal is detected in the end bit and when a certain storage capacity remains in the one waveform buffer, waveform data of other driving waveforms are written in the one waveform buffer.

DETAILED DESCRIPTION OF PREFERRED EMBODIMENTS

Preferred embodiments according to the present invention will be disclosed with reference to the attached drawings.

A first embodiment of a driving-waveform generating apparatus according to the present invention is used for a color ink-jet printer in which several driving waveforms are generated for discharging ink drops of various weights for corresponding colors to operate a piezoelectric vibrator provided for each of several nozzles of a print head for each color, thus discharging ink drops of weights in accordance with the driving waveforms through the nozzles for the corresponding colors.

Figure 1:
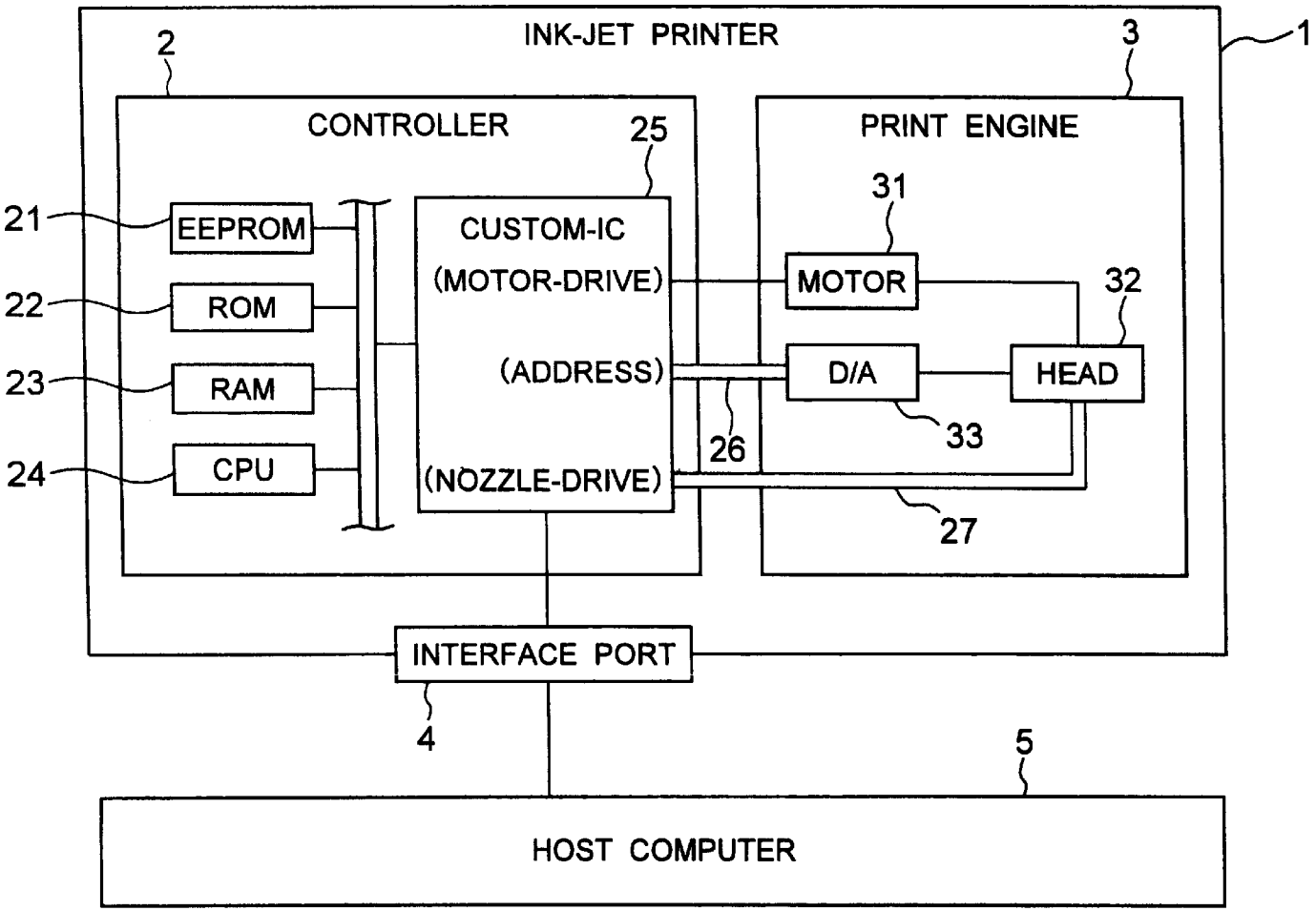
FIG. 1 is a schematic illustration of an ink-jet printer hardware.
Figures 2, 3:
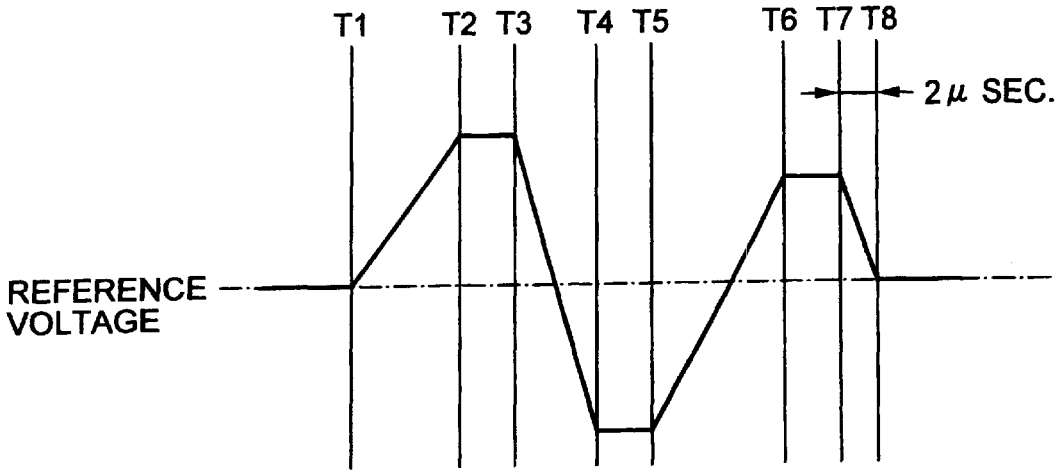
FIG. 2 is graph showing an example of a head driving-voltage waveform.
FIG. 3 indicates data stored in address spaces in a memory.
Figure 4:
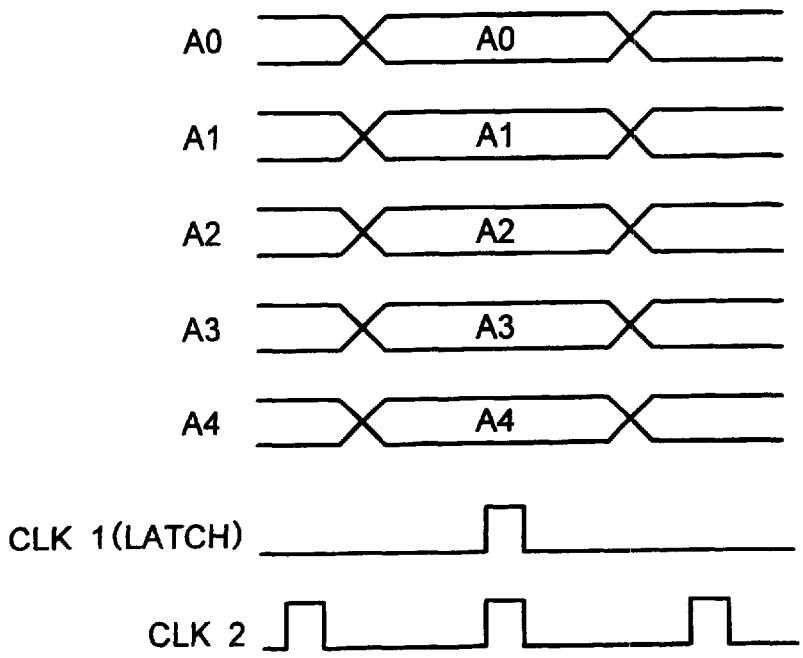
FIG. 4 is a timing chart for each signal line of a transfer line in data transfer.
Figure 5:
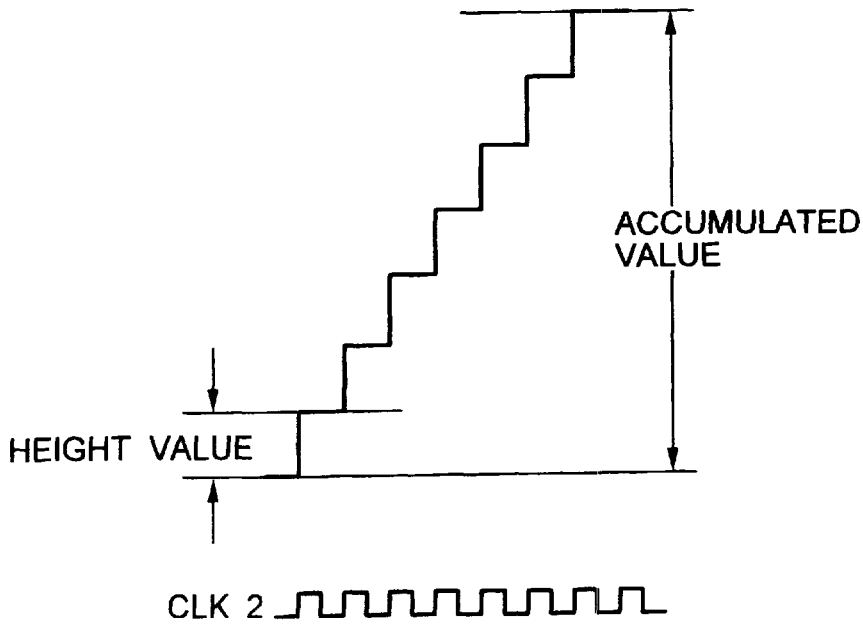
FIG. 5 illustrates addition of height values (right column in Table 30) corresponding to the addresses in FIG. 4 by the number of clocks to obtain a height of one directed segment.

The overall structure of this ink-jet printer is almost identical to that shown in FIG. 1, and hence its drawing is omitted.

The driving-waveform generating apparatus in this embodiment is provided with two waveform buffers per color. Waveform data is retrieved (read) from one of the waveform buffers to generate waveform data for the overall driving waveforms while the next driving-waveform data is written into the other buffer (double-buffer system).

Figure 6:
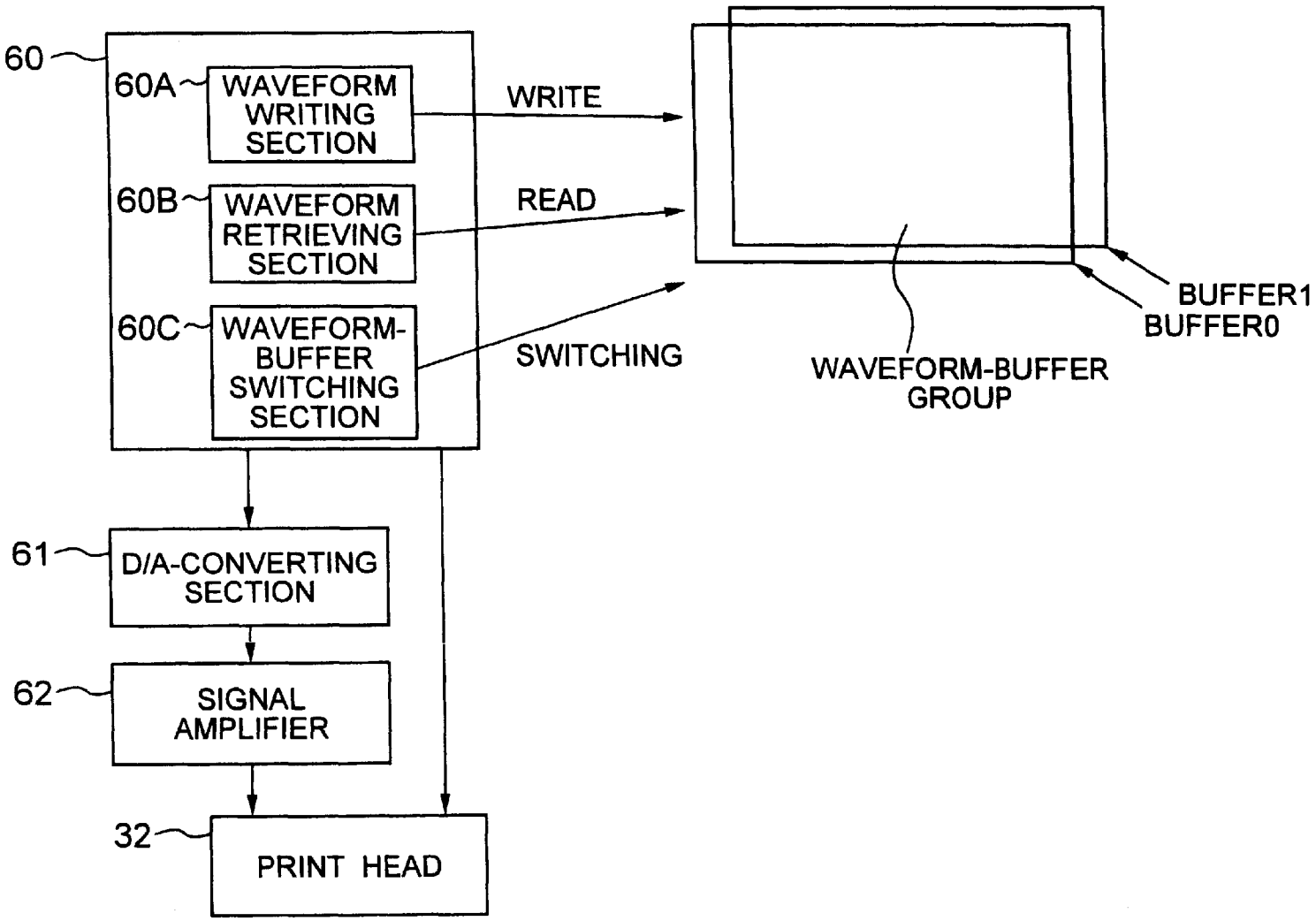
FIG. 6 shows a first embodiment of an apparatus for generating waveforms for driving an ink-jet print head according to the present invention.

As shown in FIG. 6, the driving-waveform generating apparatus in this embodiment is equipped with waveform-buffer groups BUFFER 0 and BUFFER 1, a waveform converting section 60 that forms driving waveforms and control signals on the waveform-buffers 0 and 1, a D/A-converting section 61 that converts waveform data for the overall driving waveforms output from the waveform converting section 60 into analog signals by digital/analog conversion, and a signal amplifier 62 that amplifies the analog driving-waveform signals output from the D/A-converting section 61.

The waveform converting section 60 has a waveform writing section 60A for writing waveform data for the overall driving waveforms into the waveform buffer BUFFER 0 or BUFFER 1 at an appropriate timing, a waveform retrieving section 60B for retrieving the waveform data for the overall driving waveforms from the waveform buffer BUFFER 0 or BUFFER 1 written by the waveform writing section 60A, and a waveform-buffer switching section 60C for switching between the waveform buffers BUFFER 0 and BUFFER 1 for writing and retrieving.

The waveform data for the overall driving waveform output from the waveform converter 60 are converted into analog driving-waveform signals by the D/A-converting section 61 and amplified by the signal amplifier 62, thus being applied to the print head 32 (FIG. 1 being also referred to).

The waveform writing section 60A, the waveform retrieving section 60B and the waveform-buffer switching section 60C are mainly composed of control programs stored in the CPU 24 and ROM 22 disclosed above.

The D/A-converting section 61 includes an IC (Integrated Circuit) for D/A conversion. The signal amplifier 62 mainly includes an operational amplifier (not shown) for signal amplification.

The waveform-buffer groups BUFFER 0 and BUFFER 1 are formed in the RAM 23 shown in FIG. 1. The RAM 23 in the driving-waveform generating apparatus in this embodiment is used not only as a receiver buffer, a work memory and an image buffer, but also as a waveform buffer in which waveform data for the overall driving waveforms are temporarily stored.

As already disclosed, the driving-waveform generating apparatus in this embodiment used for a color ink-jet printer is provided with two waveform buffers (BUFFER 0 and BUFFER 1) per color as waveform-buffer groups in the RAM 23. Waveform data is retrieved from one of the waveform buffers (BUFFER 0 and BUFFER 1) per color to generate waveform data for the overall driving waveforms while the next driving-waveform data is written into the other buffer (BUFFER 1 and BUFFER 0), called double-buffer system.

Figure 7:
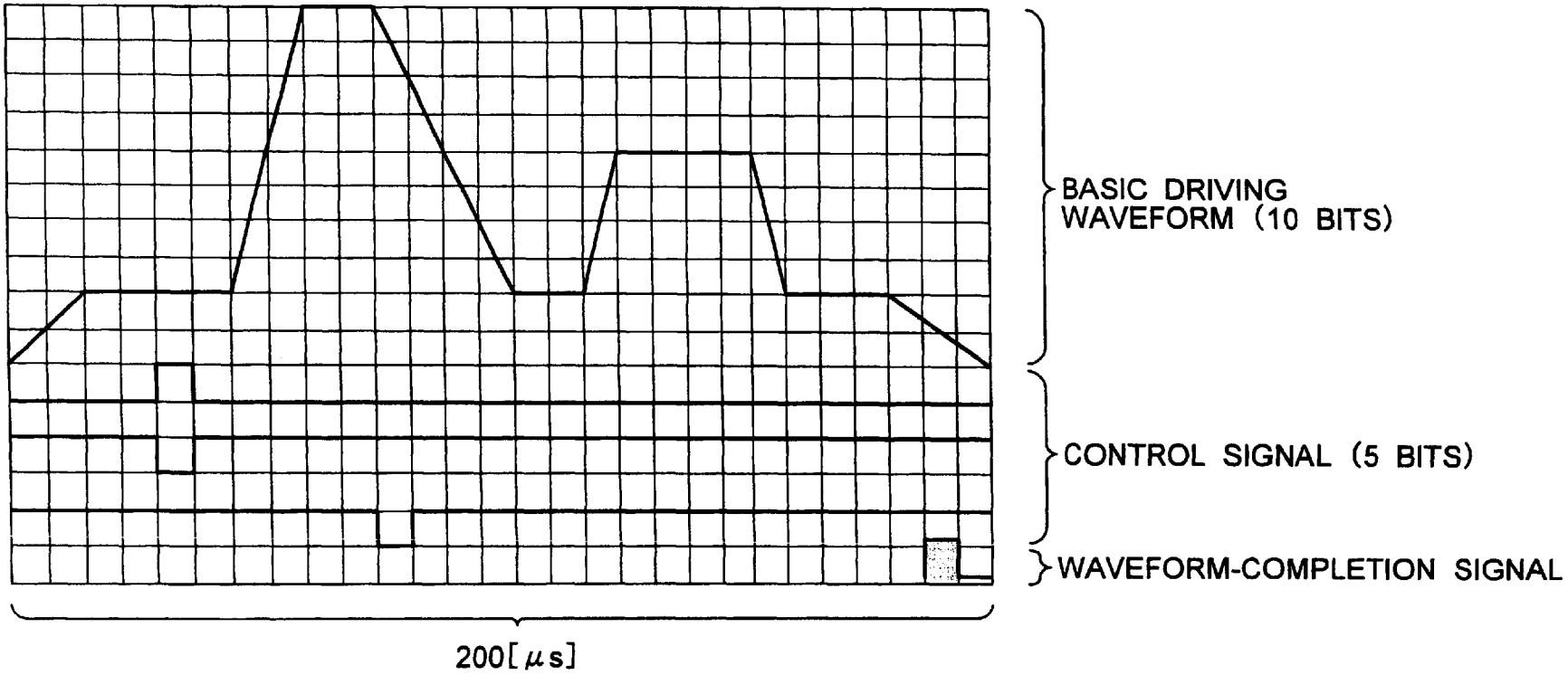
FIG. 7 illustrates a waveform buffer BUFFER 0 or BUFFER 1 in the waveform generating apparatus shown in FIG. 6.

FIG. 7 shows one of the waveform buffers BUFFER 0 and BUFFER 1. The waveform buffer BUFFER 0 or BUFFER 1 has a 16. 4-KB storage capacity, for example. Waveform data for the overall driving waveforms COM per given unit are written in the upper 10 bits on a 16-bit width in the longitudinal direction. A control signal CS other than the driving waveforms COM is written in the lower 6 bits. The least significant bit is used for waveform-completion notification (waveform-completion signal) ES.

A head-control waveform cycle is usually about 7.2 [KHz]=140 [s] (200 [s] with a margin) at most, and this is repeated. About 24-MHz sampling clocks at accuracy of 10 bits are enough for generating basic driving waveforms (several units of trapezoidal waveforms classified for formation of large, medium and small dots are called basic driving waveforms) among head-driving waveforms. It is enough that six bits are used for the control signal CS, among which one bit is used for the waveform-completion notification (waveform-completion signal) ES.

The waveform buffer BUFFER 0 or BUFFER 1 is thus configured as shown in FIG. 7 as a readable/writable memory.

The storage capacity of the waveform buffers BUFFER 0 and BUFFER 1 is expressed as follows:

$$\text{Wave_Memory}=16[\text{bit}]\times 200\ [s]/(1/24[\text{MHz}]\approx 16.4[\text{KB}]$$

Operations of the waveform converter 60 is disclosed next.

Figure 8:
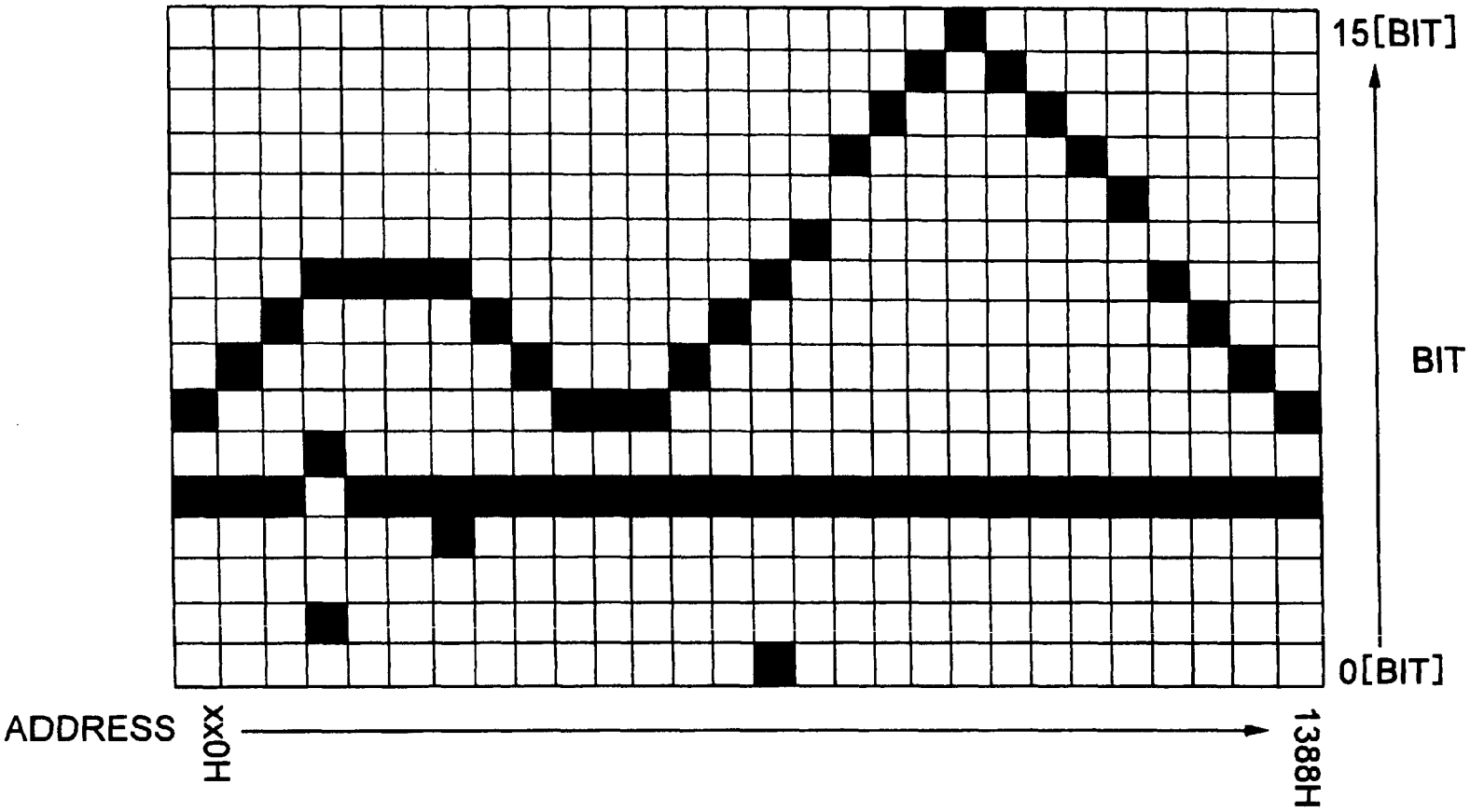
FIG. 8 illustrates a writing operation to the waveform buffer BUFFER 0 or BUFFER 1 in the waveform generating apparatus shown in FIG. 6.

The waveform writing section 60A performs a writing operation (waveform-data writing), as illustrated in FIG. 8, such that one word-length data is written in either the waveform buffer BUFFER 0 or BUFFER 1 at a one page-writing timing from low addresses.

Figure 9:
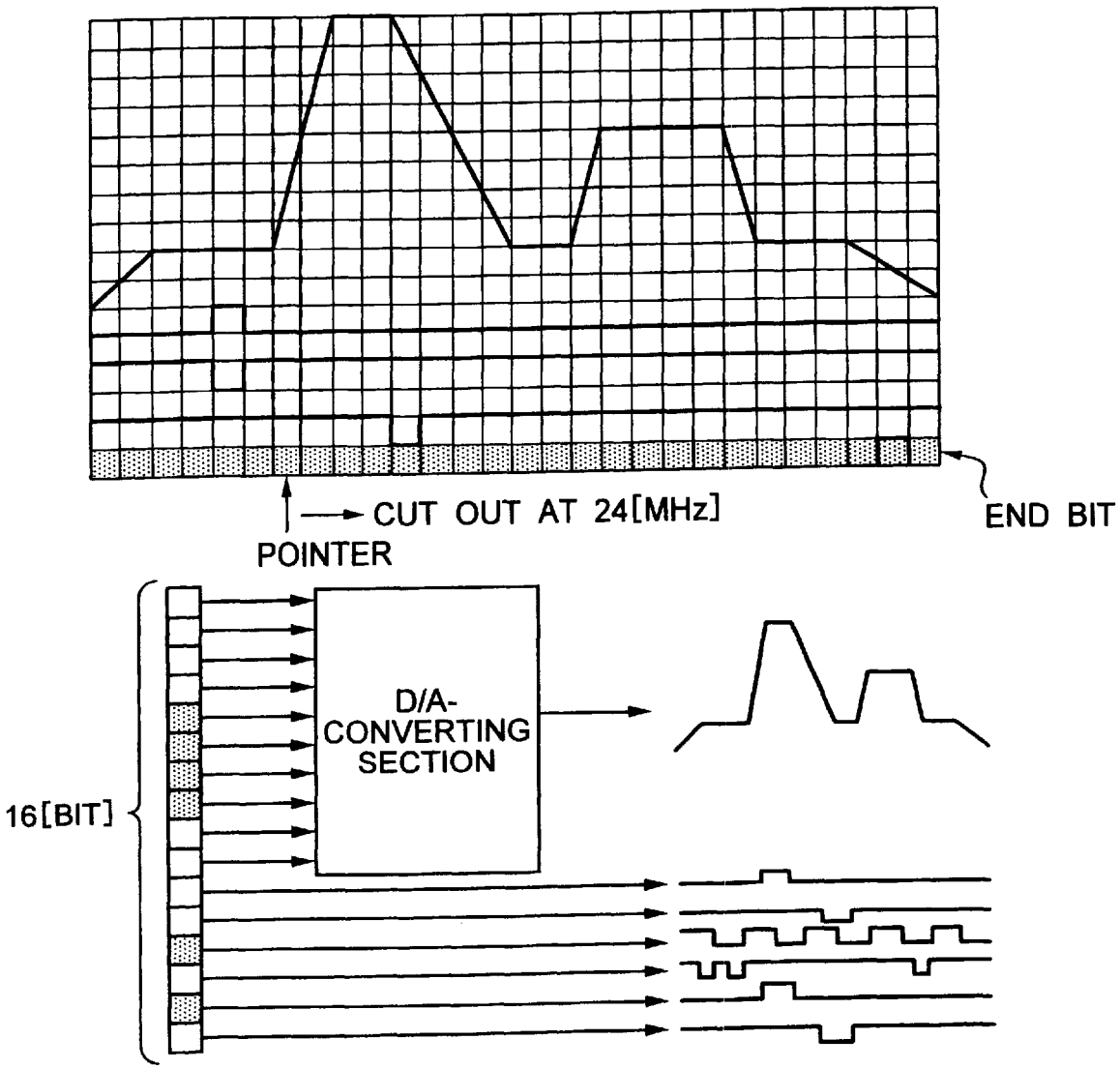
FIG. 9 illustrates a reading operation from the waveform buffer BUFFER 0 or BUFFER 1 in the waveform generating apparatus shown in FIG. 6.

The waveform retrieving section 60B performs a retrieval operation (waveform output), as illustrated in FIG. 9, such that images (16 bits) formed in the waveform buffer BUFFER 0 or BUFFER 1 are simultaneously cut out in the longitudinal direction at a 24 MHz-timing.

Ten-bit basic driving waveforms among the cut-out images are converted into analog driving-waveform signals by the D/A-converting section 61. The analog driving-waveform signals are amplified by the signal amplifier 62 and applied to the print head 32.

On the contrary , the lower 6-bit control signal other than the driving waveforms is output as it is as the control signal CS with no D/A conversion.

As illustrated in FIG. 9, addresses indicated by pointers are updated whenever images are simultaneously cut out in the longitudinal direction at the 24-MHz timing.

The least significant bit (0 bit) for the cut-out images is used as the end bit for detection of driving-waveform completion (cycle).

Figure 10:
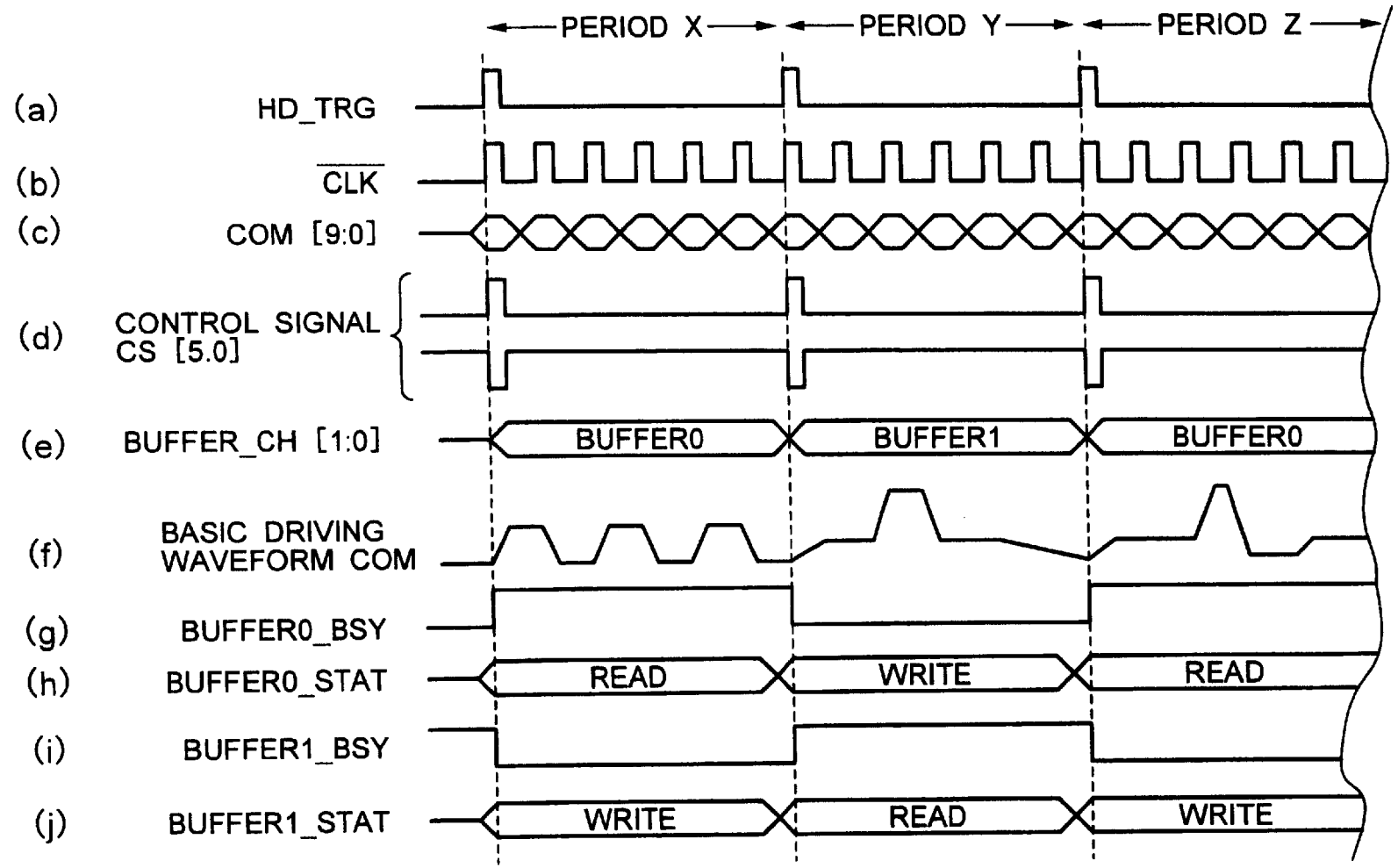
FIG. 10 is a timing chart for generation of basic driving-waveform data and control signals by a waveform converting section, and switching between the waveform buffers BUFFER 0 and 1 by a waveform-buffer switching section of the waveform converter in the waveform generating apparatus shown in FIG. 6.

Disclosed next with reference to FIG. 10 is generation of the basic driving-waveform data and the control signals performed by the waveform converter 60, and switching between the waveform buffers BUFFER 0 and BUFFER 1 performed by the waveform-buffer switching section 60C of the waveform converter 60.

As shown in FIG. 10(*a*), the waveform converting section 60 starts to operate in response to a head-trigger signal HD-TRG (supplied from a CPU or an encoder used for print head-driving timing control).

For each 24-MHz clock CLK shown in FIG. 10(*b*), the waveform converter 60 outputs 10-bit basic driving-waveform data COM [9:0] shown in FIG. 10(*c*) written in the waveform buffer BUFFER 0 or BUFFER 1, and also a 6-bit control signal CS [5:0] shown in FIG. 10(*d*) for one cycle.

The waveform-buffer switching section 60C switches the waveform buffers BUFFER 0 and BUFFER 1 alternately, as shown in FIGS. 10(*e*) to 10(*j*). In detail, the waveform buffers BUFFER 0 and BUFFER 1 are switched alternately at the timing of head-trigger signal HD-TRG shown in FIG. 10(*a*) under a waveform-switching signal BUFFER-CH [1:0] shown in FIG. 10(*e*).

The waveform-switching signal is a dedicated control signal as a switching command as to which waveform buffer is subjected to retrieval. Among periods X, Y and Z for FIGS. 10(*a*) to 10(*j*), the waveform buffer BUFFER 0 is under retrieval for the period X, the waveform buffer BUFFER 1 is under retrieval for the period Y, and again the waveform buffer BUFFER 0 is under retrieval for the period Z.

FIG. 10(*f*) illustrates basic driving waveforms retrieved from the waveform buffer BUFFER 0 or BUFFER 1 for the periods X, Y and Z, respectively. FIG. 10(*g*) is a busy signal for inhibiting the waveform buffer BUFFER 0 to be rewritten because it is under retrieval for the periods X and Z. FIG. 10(*h*) is a status signal for the waveform buffer BUFFER 0 as to whether it is under retrieval or rewriting. FIG. 10(*i*) is a busy signal for inhibiting the waveform buffer BUFFER 1 to be rewritten because it is under retrieval for the period Y. FIG. 10(*j*) is a status signal for the waveform buffer BUFFER 1 as to whether it is under retrieval or rewriting.

A basic driving-waveform data COM retrieved from the waveform buffer BUFFER 0 for the period X consists of three successive trapezoidal waves having intervals, as shown in FIG. 10(*f*). Another basic driving-waveform data COM retrieved from the waveform buffer BUFFER 0 for the period Z consists of completely different trapezoidal waves, as shown in FIG. 10(*f*). This is because waveform images in the waveform buffer BUFFER 0 have been rewritten for the period Y, as shown in 10(*h*).

Generation and switching on waveforms related to the print head are performed accordingly.

The waveform data formed in the waveform buffer BUFFER 0 or BUFFER 1 are digital data, and hence converted into analog signals by a D/V converter (not shown) of the D/V-converting section 61.

The analog signals output from the D/V-converting section 61, that carry desired driving waveforms, are amplified by the signal amplifier 62 before being output. A 10-bit digital data is converted into an analog output by the D/V-converting section 61, and hence its output voltage has 0V (0000000000) to 2V (1111111111) as peak-to-peak voltages. The analog signal output from the D/V-converting section 61 is amplified by the signal amplifier 62 to about 40V that is required for driving the print head (piezoelectric vibrator) 32.

The control signal CS for the print head 32 written in the lower 6 bits in the waveform buffer BUFFER 0 or BUFFER 1 other than the driving waveform COM is output to the print head 32 as it is as a digital signal.

As disclosed, the feature of this embodiment is that the print head-driving waveform and the other control signal, completely different from each other, are both written on the same canvas, in detail, the driving waveform, originally analog signal (data), and the control signal CS, digital signal (data), other than the driving waveform COM, are both written on the same memory, the waveform buffer BUFFER 0 or BUFFER 1 and retrieved therefrom. The driving waveform is converted into the original analog signal after retrieved from the waveform buffer BUFFER 0 or BUFFER 1 and then amplified to a voltage level enough for driving the print head (piezoelectric vibrator) 32.

The present invention is disclosed so far as applied to a specific embodiment, however, not only limited to that, various change and modification may be made in the invention without departing from the spirit and scope thereof.

The foregoing embodiment performs temperature compensation under consideration of ink conditions in printing based on printer-peripheral temperatures. Ink conditions in printing may also be considered.

Moreover, waveform-buffer groups may not be limited to the two waveform buffers BUFFER 0 and BUFFER 1 per color.

For example, as a modification to the first embodiment, five waveform buffers BUFFER 0 to BUFFER 4 may be used as waveform-buffer groups per color for micro vibration (except printing)-driving waveforms, start-up driving waveforms, forward driving waveforms, backward driving waveforms, and end-mode driving waveforms, respectively.

A large memory-storage capacity is, however, required not only for waveform buffers in writing such several types of driving waveforms per color but also for preparing (pre-storing) such several types of driving waveforms.

What is needed to be considered is thus waveform-buffer arrangements in which several types of driving waveforms can be written in waveform buffers while saving on storage capacity.

Figure 11:
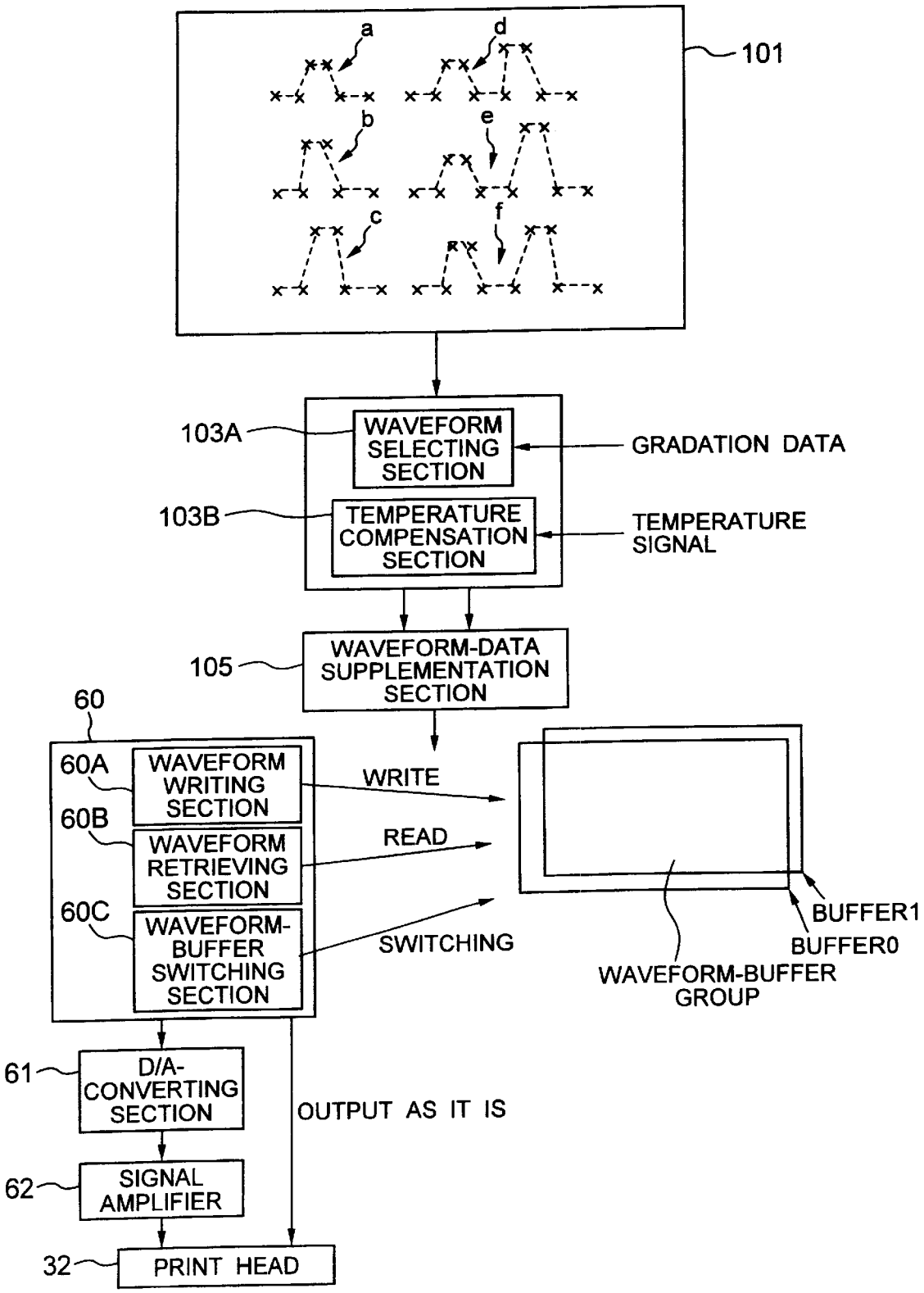
FIG. 11 shows a second embodiment of an apparatus for generating waveforms for driving an ink-jet print head according to the present invention.
Figure 12:
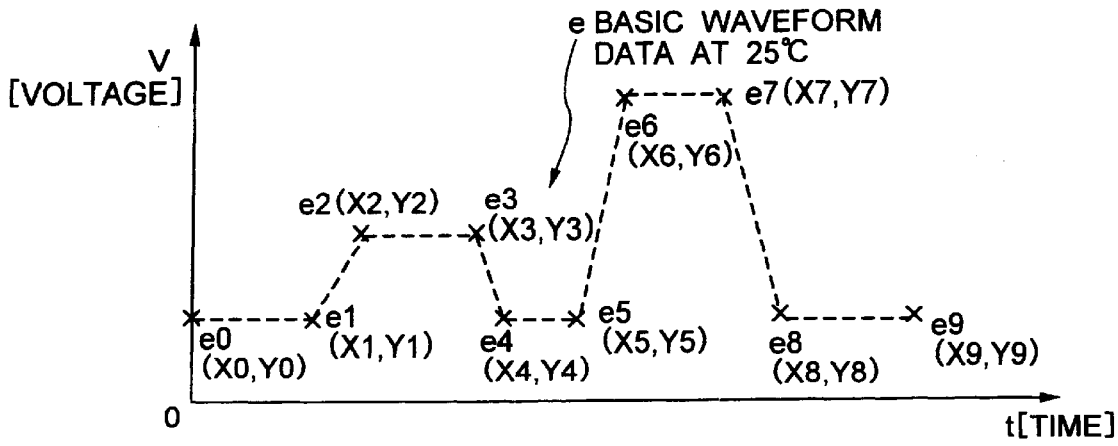
FIG. 12 illustrates a coordinate-data group to be stored in a waveform-data storing section 10 in the waveform generating apparatus shown in FIG. 11.
Figure 13:
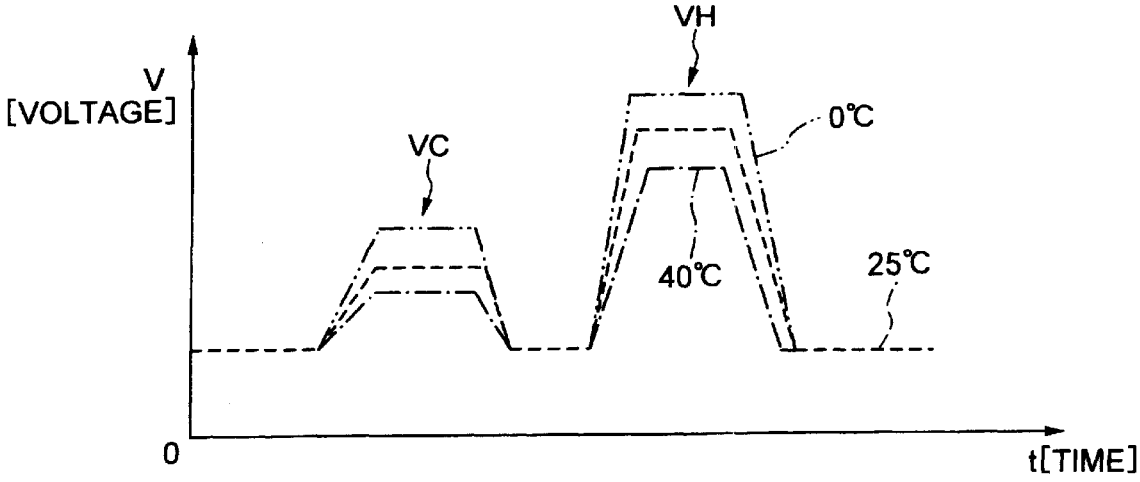
FIG. 13 illustrates temperature correction to the coordinate-data group by a temperature compensation section 103B in the waveform generating apparatus shown in FIG. 11.

A second embodiment having such arrangement according to the present invention is disclosed with reference to FIGS. 11 to 13.

Like the first embodiment, the second embodiment of a driving-waveform generating apparatus according to the present invention is also used for an ink-jet printer in which several driving waveforms are generated for discharging ink drops of various weights for corresponding colors to operate a piezoelectric vibrator provided for each of several nozzles of a print head for each color, thus discharging ink drops of weights in accordance with the driving waveforms through the nozzles for the corresponding colors.

The driving-waveform generating apparatus in this embodiment is also provided with two waveform buffers per color. Waveform data is retrieved from one of the waveform buffers to generate waveform data for the overall driving waveforms while the next driving-waveform data is written into the other buffer (double-buffer system).

In the driving-waveform generating apparatus in this embodiment, data to be prepared (stored) in the ROM 22 is not all waveform patterns to be written in the waveform buffers BUFFER 0 and BUFFER 1, but a minimum amount of data required for generating target driving waveforms, that are supplemented for generating all of the target driving waveforms before written in the waveform buffers BUFFER 0 and BUFFER 1.

A supplementation time is required, however, in this embodiment, it is performed such that data is supplemented for waveform data to be written in the waveform buffer BUFFER 1 or BUFFER 0 during which waveform data is retrieved from one of the waveform buffer BUFFER 0 or BUFFER 1 (double-buffer system).

The minimum data supplementation in this embodiment includes temperature compensation and inter-point data interpolation. In detail, the feature of the invention in this embodiment is as follows:

Several driving waveforms "a" to "f" are assumed, that carry trapezoidal waveforms under pre-consideration of ink conditions at a basic temperature. Data to be prepared (stored) are not all the data for the driving-waveforms "a" to "f", but only coordinate data on broken points of each driving (trapezoidal) waveform.

Temperature compensation is applied to the coordinate data on the broken points of each driving (trapezoidal) waveform at the basic temperature under consideration of printer-peripheral temperatures, with interpolation of values between the broken points, and the supplemented data are written in the waveform buffer BUFFER 0 or BUFFER 1.

These sequential processing are performed while waveform data are retrieved from the other waveform buffer BUFFER 1 or BUFFER 0.

The driving-waveform generating apparatus in this embodiment is provided with all the structure in the first embodiment and also the following structure in front stage of the waveform converting section 60.

In detail, the driving-waveform generating apparatus in this embodiment has a waveform-data storing section 101 that stores coordinate value-digital data on several points (broken points X of trapezoidal waveforms in FIG. 11) for several driving-waveforms "a" to "f" that are assumed under pre-consideration of ink conditions at a given temperature, a waveform selecting section 103A that selectively retrieves, during printing, several coordinate value-digital data on several points (10 broken points X in FIG. 11) on a desired driving waveform (for example, a driving waveform "e") among the driving-waveforms "a" to "f" based on gradation data, a temperature compensation section 103B that performs temperature correction to the coordinate value-data on the several points (10 broken points X on the driving waveform "e", which is the same for the following description) retrieved by the waveform selecting section 103A based on the difference between the present temperature and the above given temperature, and a waveform-data supplementation section 105 that interpolates inter-point values to the coordinate value-data on the several points output from the temperature compensation section 103B to generate waveforms.

The waveform-data storing section 101 has the ROM 22 of the printer controller 2 (FIG. 1). Stored in storage areas in the ROM 22 are coordinate values with time on the ordinate and voltage on the abscissa of the several points (X in FIG. 11) on the several driving waveforms "a" to "f" for which voltages, etc., at a given temperature have already been obtained under consideration of ink conditions.

The waveform-data selecting section 103A has the CPU 24 of the printer controller 2 (FIG. 1). The section 103A selectively retrieves coordinate-value data of the several points (10 broken points X in FIG. 11) on a desired driving waveform (for example, driving waveform "e") corresponding to gradation data, from the waveform-data storing section 101.

The temperature compensation section 103B has the CPU 24 (FIG. 1) and a thermistor (not shown) attached to the print head 32. For example, temperature increase will cause decrease in resistance of the thermistor. Resistance variation between a given temperature at assumption of driving waveforms and the present temperature is thus converted into an electric signal via the thermistor.

In response to the electric signal, the temperature compensation section 103B adjusts the coordinate-value data of the several points (10 broken points X on the waveform "e" for example, which is the same for the following description).

The waveform-data supplementation section 105 has a gate array (the custom-IC chip in FIG. 1). The section 105 (gate array) is interrupted for inter-point interpolation calculation in waveform generation.

Operations of the driving-waveform generating apparatus in this embodiment are disclosed with reference to FIG. 11 and also FIGS. 12 and 13.

A printer designer stores absolute coordinate values in storage areas in the ROM 22 of the waveform-data storing section 101. The absolute coordinate values have time "t" on the ordinate and voltage "v" on the abscissa of the several broken points (X in FIG. 11) on the several driving waveforms "a" to "f" for which voltages, etc., at a given temperature have already been obtained under consideration of ink conditions.

The above given temperature is 25° C. in this embodiment under consideration of environmental temperatures in the range from 10° C. to 40° C. for general printers.

As shown in FIG. 12, for example, for the driving waveform "e", ten broken points e0 to e9 on a basic waveform data at 25° C. are stored as absolute coordinate values (X0, Y0) to (X9, Y9) with time "t" on the ordinate and voltage "v" on the abscissa.

The same operation is executed, for example, by six times for six driving waveforms for the print head 32 of the ink-jet printer.

As disclosed, the data-entry operation in this embodiment is very easy because a printer designer just stores broken points, for example, e0 to e9 on a basic waveform data at 25° C. as absolute coordinate-value data, which is also preferable in view of user interface.

The absolute coordinate values are coordinate values that are two values on the ordinate and the abscissa corresponding to each broken point in a coordinate system with time "t" on the ordinate and voltage "v" on the abscissa.

When the ink-jet printer having the driving waveform generating apparatus in this embodiment starts printing, the waveform-data selecting section 103A selectively retrieves data on a desired driving waveform from among several driving waveforms, such as, the several points e0 to e9 of the driving waveform "e" from the storage area in the waveform-data storing section 101.

The retrieved data on the points e0 to e9 are adjusted by the temperature compensation section 103B by a predetermined interval based on the environmental temperature in printing and the given temperature 25° C.

Ink is soft at high temperatures but hardened at low temperatures. The environmental temperature could be different between when coordinate data for driving waveforms are pre-stored in the waveform-data storing section 101 and during printing. Moreover, the temperature inside the printer will increase due to heat generated from various internal devices.

It is thus required to adjust a voltage of a basic driving waveform at the given temperature 25° C. to be applied to the print head in accordance with the temperature during printing. In this embodiment, coordinate data of several points on driving waveforms selectively retrieved by the waveform-data selecting section 103A are subjected to temperature compensation.

For example, the driving waveform "e" is adjusted according to a known temperature-compensation formula so that a driving voltage VH and an intermediate voltage VC are adjusted to low voltages when the environmental temperature during printing is higher than 25° C. whereas to high voltages when it is lower than 25° C. The coordinate-value data on the points e0 to e9 are then adjusted in accordance with this voltage adjustments.

The temperature compensation is executed for each completion of one-page printing in this embodiment. In detail, resistance variation in the thermister (not shown) attached to the print head 32 is converted into an electric signal and input to the CPU 24 that constitutes the temperature compensation section 103B. The CPU 24 adjusts the absolute coordinate-value data of the points e0 to e9 on the driving waveform "e", for example, in accordance with a known temperature-compensation formula pre-stored in the ROM 22. In the following one-page printing, waveforms are generated based on the adjusted coordinate-value data of the points e0 to e9.

After the temperature compensation, inter-point value interpolation is performed by the waveform-data supplementation section 105 based on the temperature-compensated coordinate data.

This interpolation can be performed according to a known interpolation processing. In detail, the temperature-compensated coordinate data are subjected to functional approximation by a known interpolation formula for obtaining values between points on a waveform.

The desired driving waveform data generated by the waveform-data supplementation section 105 is sent to the waveform converting section 60 and written in the waveform BUFFER 0 or BUFFER 1 by the waveform writing section 60A. As disclosed above, thereafter, the waveform buffer BUFFER 1 or BUFFER 0 are switched so that the waveform data for the overall driving waveforms that have been subjected to temperature compensation and inter-point interpolation are written in the waveform buffer BUFFER 1 or BUFFER 0 while the waveform data is retrieved from the other waveform buffer BUFFER 0 or BUFFER 1.

This embodiment requires no overall driving waveform pattern data of several types to be prepared (stored) beforehand, thus not requiring a large storage capacity. It is thus achieved that several types of driving waveforms are formed in waveform buffers while saving on memory storage capacity.

The several driving waveforms "a" to "f" at the basic temperature may be prepared (stored) in an application-specified integrated circuit (ASIC) instead of ROM in a printer controller.

As disclosed above, according to the present invention, waveform data for the overall head-driving waveforms per given unit are written in waveform buffers and then sequentially retrieved at a given timing for analog conversion to obtain an analog head-driving waveform signal per given unit.

The present invention thus achieves easy programmable generation of various and complex head-driving waveforms with no restriction on the number of gradients.

Moreover, the present invention is applicable to generation of further complex driving waveforms for further multilevel dots in multiple gradation expression.

Accordingly, the present invention provides an apparatus and a method of appropriately generating desired waveforms for driving an ink-jet print head with a simple configuration.

Moreover, the present invention provides an apparatus and a method of generating several and complex waveforms for driving an ink-jet print head for multiple gradation.

What is claimed is:

1. An apparatus for generating at least one assumed waveform for driving an ink-jet print head in accordance with gradation data, wherein said apparatus writes waveform data for overall head-driving waveforms per given unit in waveform buffers and sequentially retrieves the waveform data at a given timing for analog conversion to obtain an analog head-driving waveform signal per given unit, thus generating said at least one assumed waveform for driving an ink-jet print head.

2. An apparatus for generating at least one assumed waveform for driving an ink-jet print head in accordance with gradation data, comprising:

a waveform-data writing section for appropriately writing waveform data for overall head-driving waveforms;

a waveform-data retrieving section for retrieving the waveform data written in the waveform-data writing section;

a digital/analog converting section for converting the waveform data retrieved by the waveform-data retrieving section into an analog signal by digital/analog conversion; and a signal amplifying section for amplifying the analog signal output from the digital/analog converting section.

3. The apparatus for generating waveforms for driving an ink-jet print head according to claim 2, wherein the waveform-data writing section includes at least one waveform buffer in which the waveform data for the overall head-driving waveforms are temporarily written.

4. The apparatus for generating waveforms for driving an ink-jet print head according to claim 3, wherein the waveform-data writing section includes a waveform-buffer group having a plurality of waveform buffers, waveform data for overall various driving waveforms having been written in the waveform buffers, the waveform-data retrieving section selecting any one of the waveform buffers in the waveform-buffer group to retrieve the waveform data.

5. The apparatus for generating waveforms for driving an ink-jet print head according to claim 4, wherein the waveform-buffer group has two waveform buffers, the waveform data being retrieved from one of the waveform buffers for generating waveform data for overall head-driving waveforms while a next waveform data is written in the other waveform buffer.

6. The apparatus for generating waveforms for driving an ink-jet print head according to claim 4, wherein the waveform-buffer group comprises respective waveform buffers for start-up driving waveforms, end-mode driving waveforms, forward driving waveforms, backward driving waveforms, and micro vibration (except printing)-driving waveforms.

7. The apparatus for generating waveforms for driving an ink-jet print head according to claim 4 being used for a color ink-jet printer, wherein the waveform-buffer group is provided per color.

8. The apparatus for generating waveforms for driving an ink-jet print head according to claim 4, further comprising:

a waveform-data storing section for storing at least one assumed driving-waveform data, at least two data points being included in the assumed driving-waveform data being stored in the waveform-data storing section as a coordinate-data group.

9. The apparatus for generating waveforms for driving an ink-jet print head according to claim 8, further comprising:

a waveform-data supplementation section for interpolating values between the at least two data points of the coordinate-data group, thereby generating data on the overall head-driving waveforms.

10. The apparatus for generating waveforms for driving an ink-jet print head according to claim 9, wherein the waveform-buffer group has two waveform buffers, the waveform data being retrieved from one of the waveform buffers while the waveform-data supplementation section is interpolating the values between the at least two data points of the coordinate-data group, thereby generating data on the overall head-driving waveform, the data on the overall head-driving waveforms being written in the other waveform buffer.

11. The apparatus for generating waveforms for driving an ink-jet print head according to claim 9, further comprising:

an adjusting section for adjusting a selected driving-waveform data based on ink conditions in printing.

12. The apparatus for generating waveforms for driving an ink-jet print head according to claim 11, wherein the waveform data is retrieved from one of the waveform buffers while the adjusting section is adjusting the selected driving-waveform data based on the ink conditions in printing, and the waveform-data supplementation section is interpolating the values between the at least two data points of the coordinate-data group, thereby generating data on the overall head-driving waveforms, the data on the overall head-driving waveforms being written in the other waveform buffer.

13. The apparatus for generating waveforms for driving an ink-jet print head according to claim 11, wherein the ink conditions are considered based on at least an environmental temperature.

14. The apparatus for generating waveforms for driving an ink-jet print head according to claim 3, wherein the waveform data retrieving section sequentially retrieves the waveform data on the overall head-driving waveforms stored in the at least one waveform buffer per data portion at a given timing for generating the waveform data on the overall head-driving waveforms.

15. The apparatus for generating waveforms for driving an ink-jet print head according to claim 3, wherein at least one trapezoidal waveform is included in the generated driving waveforms for gradation, in which dots are formed using the driving waveform.

16. The apparatus for generating waveforms for driving an ink-jet print head according to claim 3, wherein written in the at least one waveform buffer is a print head-control signal other than the waveform data for overall head-driving waveforms, the control signal being retrieved by the waveform-data retrieving section and being applied to the print head.

17. The apparatus for generating waveforms for driving an ink-jet print head according to claim 16, wherein the waveform data for overall head-driving waveforms is converted into an analog signal by the digital/analog converting section and the analog signal is amplified by the signal amplifying section, thus being output to the print head, whereas the print head-control signal other than the driving waveform is output to the print head as a digital signal.

18. The apparatus for generating waveforms for driving an ink-jet print head according to claim 16, wherein the at least one waveform buffer has a storage capacity of 16 bits in a longitudinal direction and a given number of bits in a horizontal direction, the waveform data for overall head-driving waveforms being written on an upper 10 bits among the 16 bits in the longitudinal direction, the print head-control signal other than the driving waveforms being written in a lower 6 bits among the 16 bits in the longitudinal direction.

19. The apparatus for generating waveforms for driving an ink-jet print head according to claim 18, wherein the print head-control signal other than the driving waveforms includes a waveform completion signal indicating completion of the waveforms, a least significant bit of the 16 bits in the longitudinal direction being used as an end bit in which the waveform completion signal is written.

20. The apparatus for generating waveforms for driving an ink-jet print head according to claim 19, wherein, when the waveform completion signal is detected in the end bit and when a certain storage capacity remains in the at least one waveform buffer, waveform data of other driving waveforms are written in the at least one waveform buffer.

21. The apparatus for generating waveforms for driving an ink-jet print head according to claim 3, wherein the waveform data for overall head-driving waveforms is written per one-word lengths from a low address in the at least one waveform buffer.

22. The apparatus for generating waveforms for driving an ink-jet print head according to claim 21, wherein the waveform data for overall head-driving waveforms is written in the at least one waveform buffer per page of a printing medium.

23. A method of generating at least one assumed waveform for driving an ink-jet print head in accordance with gradation data, comprising:

writing waveform data for overall head-driving waveforms in at least one waveform buffer;

retrieving the waveform data written in the at least one waveform buffer;

converting the retrieved waveform data into an analog signal; and amplifying the analog signal converted in the converting step.

24. A storage medium storing a computer-executable program for generating at least one assumed waveform for driving an ink-jet print head in accordance with gradation data, the program containing instructions for:

writing waveform data for overall head-driving waveforms in at least one waveform buffer;

retrieving the waveform data written in the at least one waveform buffer;

converting the retrieved waveform data into an analog signal; and amplifying the analog signal converted in the converting step.

* * * * *